US006320328B1

(12) United States Patent
Kenyon et al.

(10) Patent No.: US 6,320,328 B1
(45) Date of Patent: Nov. 20, 2001

(54) METHOD AND APPARATUS FOR RETROFITTING GAS DISCHARGE LAMP BALLAST FOR USE WITH GAS DISCHARGE LAMP HAVING DIFFERENT POWER RATING

(75) Inventors: Lewis W. Kenyon; Isaac L. Flory, IV, both of Blacksburg, VA (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 09/302,474

(22) Filed: Apr. 30, 1999

(51) Int. Cl.[7] ..... G05F 1/00
(52) U.S. Cl. ..... 315/291; 315/276; 315/DIG. 5
(58) Field of Search ..... 315/248, 276, 315/283, 291, 307, 58, 141, DIG. 2, DIG. 5

(56) References Cited

U.S. PATENT DOCUMENTS

| | | | | |
|---|---|---|---|---|
| 3,699,385 | * | 10/1972 | Paget | 315/DIG. 5 |
| 4,959,593 | * | 9/1990 | Joanino | 315/290 |
| 5,047,694 | | 9/1991 | Nuckolls et al. | 315/290 |
| 5,321,338 | | 6/1994 | Nuckolls et al. | 315/290 |
| 5,327,048 | | 7/1994 | Troy | 315/240 |
| 5,594,308 | | 1/1997 | Nuckolls et al. | 315/290 |
| 5,606,222 | | 2/1997 | Cottaar et al. | 315/58 |
| 5,945,786 | * | 8/1999 | Jurek | 315/276 |

* cited by examiner

*Primary Examiner*—Don Wong
*Assistant Examiner*—Thuy Vinh Tran
(74) *Attorney, Agent, or Firm*—Stacey J. Longanecker

(57) ABSTRACT

A method and apparatus are provided to retrofit a gas discharge lamp ballast designed for use with a first lamp having a first power rating to be used with a second lamp having a second power rating. The ballast has a core, a coil and a serially-connected ballast capacitance device and is characterized by a first net impedance of the ballast reactance to allow operation of the first lamp in an operating range in which the first lamp is designed to operate. When the first lamp is replaced with a second lamp having a different lamp impedance than the first lamp, the capacitance of the ballast capacitance device is selected so as to change the first net impedance of the ballast to a second net impedance which allows the ballast to maintain proper operation of the second lamp in accordance with its specifications and rating.

16 Claims, 2 Drawing Sheets

METHOD AND APPARATUS FOR RETROFITTING GAS DISCHARGE LAMP BALLAST FOR USE WITH GAS DISCHARGE LAMP HAVING DIFFERENT POWER RATING

BACKGROUND OF THE INVENTION

High intensity discharge (HID) lamps such as metal halide (MH) lamps, high pressure sodium (HPS) lamps and high pressure mercury vapor lamps have increasingly gained acceptance over incandescent and fluorescent lamps for commercial and industrial applications. HID lamps are more efficient and more cost effective than incandescent and fluorescent lamps for illuminating large open spaces such as construction sites, stadiums, parking lots, warehouses, and so on, as well as for illumination along roadways. Commercial HID lighting installations generally employ luminaires which are complete lighting units, each of which comprises a ballast and its housing, a lamp socket, and a lamp.

Additional savings with regard to further reducing energy consumption can be achieved by replacing an HID lamp of a particular type and wattage with a lower wattage HID lamp. For example, an entire luminaire having a conventional fluorescent lamp and its ballast can be replaced with a luminaire having a lower wattage HPS lamp and ballast therefor. Replacing the entire luminaire, however, is costly since all of the luminaire parts are being replaced.

As an alternative, a substitute lamp having a lower rated lamp wattage can be used with the existing ballast in a luminaire. This approach, however, is disadvantageous. Although a reduction in lamp wattage can result in an energy savings, the substitute lamp and the ballast are not matched so as to yield the most efficient performance.

A consequence of a mismatched lamp and ballast can be an increase in lamp current. The increased lamp current which occurs upon the substitution of a lamp having a lower rated lamp voltage into an existing luminaire is addressed in U.S. Pat. Nos. 5,606,222, to Cottaar et al. 5,606,222, to Cottaar et al, relates to a current-reducing device for reducing current through a lamp and ballast to reduce system wattage in a gas discharge lamp lighting system. The current-reducing device is described as a capacitor connected in parallel with the discharge lamp in a system having a lead-type ballast (e.g., a constant-wattage auto transformer (CWA)). The impedance of the parallel capacitor is selected to be between ten and twenty times the impedance of the lamp such that the capacitor is configured to take a substantial amount of current. This parallel arrangement is disadvantageous because it merely diverts energy that would normally flow through the lamp when no such arrangement is used. The reduced current through the lamp is unacceptable because it deteriorates the waveform provided to the lamp, thereby decreasing the operating life of the lamp. For example, the current crest factor increases, among other undesirable waveform changes, and prevents the lamp from operating optimally and in accordance with the lamp characteristics with which the lamp was designed to operate, including but not limited to open-voltage and sustaining voltage requirements, ignition and starting current requirements, lamp regulation requirements, and so on. Accordingly, a need exists for an apparatus and method to reduce system wattage in retrofit applications for gas discharge lamps (i.e., substitution of a typically lower wattage lamp using an existing ballast coil and core) which does not significantly shorten the operating life of the substituted, lower wattage lamp.

SUMMARY OF THE INVENTION

The above-described problems with retrofitting HID lamps with reduced wattage HID lamps are overcome by the present invention. Advantages are also realized with regard to substituting lamps in the same or different lamp-type family as the original lamp and having a higher or lower power rating. A method and apparatus are provided for converting an HID ballast for a particular lamp type and wattage to a ballast for use with a different lamp having a different power rating, thereby avoiding replacement of the core and coil of the original ballast.

In accordance with an aspect of the present invention, the series-connected ballast capacitor of a lead-type ballast is changed to a value which is selected to maintain the net impedance of the resulting ballast reactance at a correct magnitude for operating a different wattage lamp.

In accordance with an aspect of the present invention, an ignition circuit is connected across the terminals of the different lamp, if the substitute lamp requires an ignition circuit.

In accordance with an aspect of the present invention, the capacitance device is moved from between a terminal of the ballast and a first terminal of the substitute lamp to between a second terminal of the ballast connected to a neutral or grounded line and a second terminal of the substitute lamp.

BRIEF DESCRIPTION OF DRAWINGS

The various aspects, advantages and novel features of the present invention will be more readily comprehended from the following detailed description when read in conjunction with the appended drawings, in which.

Throughout the drawing figures, like reference numerals will be understood to refer to like parts and components.

DETAILED DESCRIPTION OF THE PREFERRED EMBODIMENTS

Figure 1:
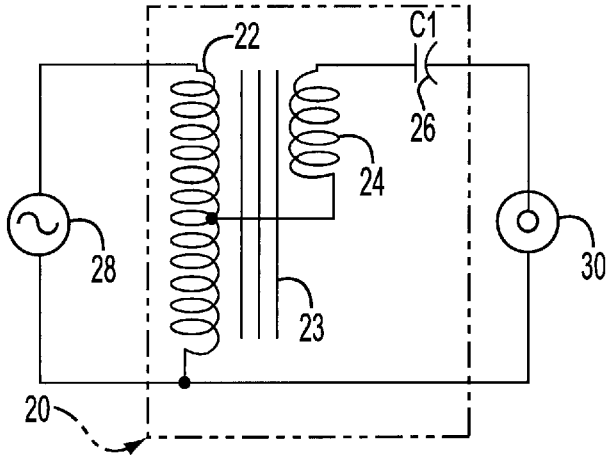
FIG. 1 (PRIOR ART)
FIG. 1 is a schematic diagram of a conventional lead-type ballast connected to a lamp.

With reference to FIG. 1, a lead-type ballast 20 (e.g., a constant-wattage autotransformer (CWA) or a peaked-lead autotransformer (PLA)) is shown connected to a lamp 30. Such lead-type ballasts account for a large portion of the installed base of the HID lamp market. The illustrated, exemplary CWA ballast 20 comprises a primary winding 22, a secondary winding 24, a core 23 and a series-connected ballast capacitor 26. The CWA ballast 20 is connected to an AC power source 28 and an HID lamp 30. With regard to the lamp 30, the ballast 20 is designed for a particular lamp-type and wattage.

Figure 2:
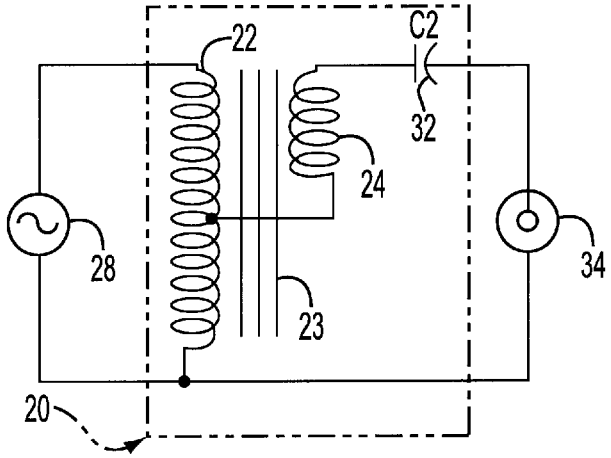
FIG. 2 is a schematic diagram of a lead-type ballast connected to a lamp power level converter in accordance with a first embodiment of the present invention for use with a substitute lamp having a different power rating.

In accordance with the present invention, the ballast 20 can be converted for use with a different lamp having a different power rating such as the lamp 34 in FIG. 2. As stated previously, energy savings and therefore cost savings can be realized by using more efficient HID lamps in place of many existing lamp-types. In the illustrated example, the lamp 30 is a 400 watt (W) MH lamp and the substitute lamp is a 320 W MH pulse-start lamp. It is to be understood that the present invention can be used with different existing lamp-types and substitute lamp-types. For example, the lamp 34 can be a 350 W lamp being substituted for the 400 W lamp 30, or a 200 W lamp being substituted for a 250 W lamp 30, and so on.

With reference to the conventional lamp circuit depicted in FIG. 1, the magnitude of the capacitor 26 is chosen such that the net impedance of the resulting ballast reactance allows for proper operation of the lamp within the specifications or ratings the for which the lamp 30 was designed when driven by the ballast secondary voltage. The specifications and ratings of lamps discussed herein are promulgated by lamp manufacturers and standards organizations such as the American National Standards Institute (ANSI) and the like. The net impedance is the vectoral sum of the core and coil secondary magnetic reactance and the capacitive reactance contributed by the ballast capacitor 26. Altering the magnitude of the capacitor 26 affects the net impedance and therefore the lamp operating parameters.

With reference to the lamp circuit depicted in FIG. 2, the capacitor 26 has been replaced with a capacitor 32, and the lamp 30 has been replaced with a lower wattage lamp 34. A number of factors are considered in selecting the capacitor 32 such as OCV requirements, starting current requirements, lamp power regulation requirements, lamp current crest factor requirements, ignition requirements and sustaining voltage requirements. A number of these factors are presented in Table 1 for the 400 W MH lamp 30 and the 320 W MH lamp 34.

TABLE 1

| Parameter | 400 W MH lamp | 320 W MH lamp |
|---|---|---|
| Lamp Operating Voltage | 120–150 $V_{rms}$ | 120–150 $V_{rms}$ |
| Lamp Operating Current | 3.25 $A_{rms}$ (Typ.) | 2.63 $A_{rms}$ (Typ.) |
| Min. Starting Voltage 10° C. Start) | 280 $V_{rms}$/504 $V_{pk}$ | 245 $V_{rms}$/465 $V_{pk}$ |
| Lamp Starting Current | 3.2–50 $A_{rms}$ | 2.6–4.1 $A_{rms}$ |

A comparison of the lamp requirements listed in Table 1 reveals that a ballast 20 designed to meet the specifications of the lamp 30 also meets the corresponding specifications of the substitute lamp 34. The lamp operating voltage is the same for both of the lamps 30 and 34. The minimum starting voltage provided by the ballast 20 is more than adequate for starting and sustaining the lamp 34. Since the lamp starting and operating requirements for the lamp 30 exceed those required by the lamp 34, the core 23 and coils 22 and 24 are capable of providing sufficient current to operate the substitute, lower-wattage lamp 34. The ballast impedance is modified in accordance with the present invention to correct the current in the lamp to maintain the lamp operating voltage. In the illustrated example, a 21 microfarad ($\mu$f) capacitor 32 is selected to replace the 24 $\mu$f capacitor 26. As indicated by the following Table 2, the smaller capacitor 32 is selected to facilitate a change in the ballast 20 to accommodate a different lamp 34 in the lamp circuit having a different lamp impedance from the lamp 30.

TABLE 2

| Operating Parameter (Advance #71A6041 core and coil) | 400 W MH lamp (24 $\mu$f capacitor) | 320 W MH lamp (21 $\mu$f capacitor) |
|---|---|---|
| Nominal Supply Voltage | 480 $V_{rms}$ | 480 $V_{rms}$ |
| Nominal Input Current | 1.02 $A_{rms}$ | 0.80 $A_{rms}$ |
| Nominal Input Power | 449.3 W | 371.3 W |
| Input Power Factor | 0.92 | 0.97 |
| Lamp Voltage | 122 $V_{rms}$ | 131 $V_{rms}$ |
| Lamp Current | 3.57 $A_{rms}$ | 2.77 $A_{rms}$ |
| Lamp Power | 379.6 W | 320.6 W |
| Ballast Losses | 69.7 W | 50.7 W |

As stated above, prior art arrangements which employ current-diverting devices across a lamp, and which do not alter ballast characteristics, merely reduce current through the lamp. This approach is unacceptable because the waveform provided to the lamp deteriorates, thereby decreasing the operating life of the lamp. The method of retrofitting a ballast in accordance with the present invention by changing the current provided through the ballast, as opposed to merely diverting the current, maintains the integrity of the waveform at the lamp. The prior art arrangements, on the other hand, compromise various waveform characteristics such as the crest factor.

The method of the present invention is generally used to replace a lamp 30 in a lamp circuit with a lamp having a lower power rating or operatingwattage. Thus, the ballast is processing less energy, and therefore current, which allows for cooler ballast temperatures due to reduced ballast losses. The lamp 34 can have a higher power level than the lamp 30. Accordingly, the ballast capacitance can be increased. Thermal issues, however, require consideration to ensure against ballast core and coil failure and the possibility of overheating surrounding components.

The ballast modification of the present invention is particularly effective when the substitute lamp 34 is from the same family of lamps (e.g., HPS or MH, among others) as the original lamp 30 and ballast 20, and has a wattage rating that is close to and less than thewattage rating of the original lamp 30. By using a substitute lamp from 34 from the same family as the original lamp 30, the lamps typically have similar operating requirements. Substituting a lamp 34 from a different family of lamps, however, can also desirable. For example, a metal halide-type lamp 34 can be substituted for an original lamp 30 from the HPS family, which used with an HPS ballast, if the MH lamp color is preferred over the HPS lamp color.

As stated previously, substituting a lamp 34 having a higher power rating than the original lamp 30 can increase ballast losses and, depending on the nominal operating temperature, overheat the ballast and cause the premature failure thereof. If, however, the thermal characteristics of the ballast are known, and ballast modification in accordance with the present invention will not cause ballast limitations to be exceeded, then a lamp 34 having a higherwattage can be used.

Figure 3:
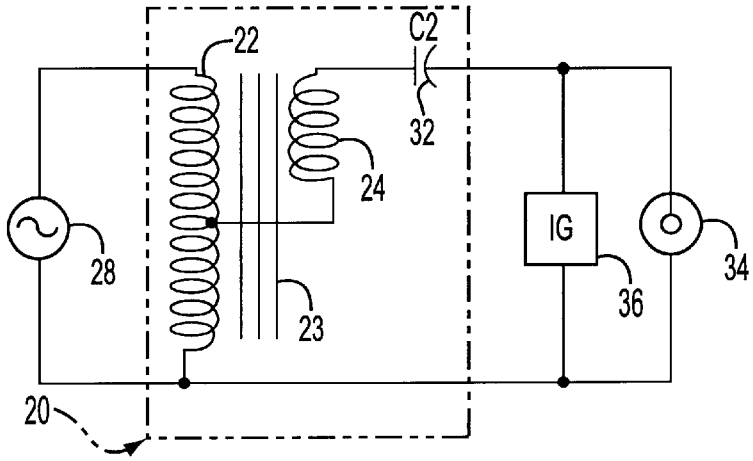
FIG. 3 is a schematic diagram of a lead-type ballast connected to a lamp power level converter and an ignitor in accordance with a second embodiment of the present invention for use with a substitute lamp having a different power rating.

A number of HID lamps require external high-voltage ignition circuits. If an existing ballast 20 is not equipped with an ignition circuit and the substitute lamp 34 requires such a circuit, a two-lead ignition circuit can be installed during the ballast modification or retrofit process of the present invention. As shown in FIG. 3, an ignition circuit 36 is provided across the lamp 34 and is operable to provide the required starting pulse for the substitute lamp 34.

Figure 4:
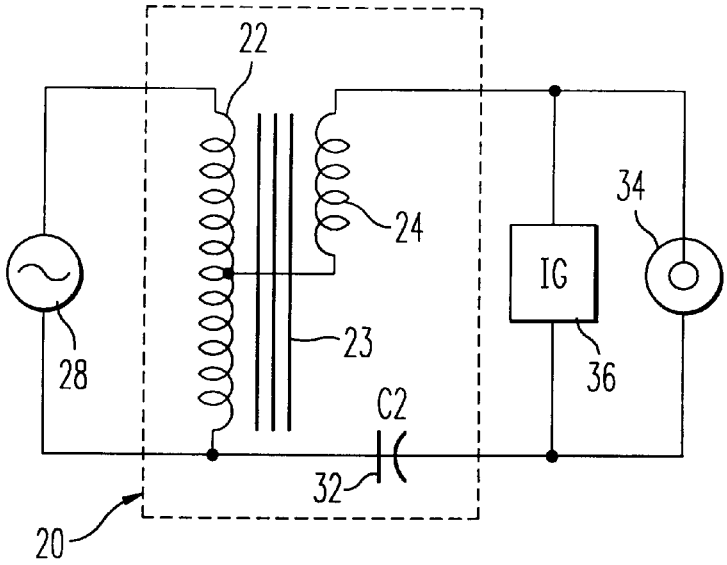
FIG. 4 is a schematic diagram of a lead-type ballast connected to a lamp power level converter and an ignitor in accordance with a third embodiment of the present invention for use with a substitute lamp having a different power rating.

The lamp circuit depicted in FIG. 4 is similar to the circuit depicted in FIG. 3, except that the capacitor 32 is provided after the lamp 34 and ignition circuit 36. This placement of the capacitor 32 in the lamp circuit is advantageous when the neutral line supplying the ballast 20 is grounded, or when an ignition circuit is introduced to a ballast which had no prior ignition circuit. When an ignition circuit is introduced into a PLA ballast housing, for example, the metal case of the capacitor 32 needs to be grounded to the luminaire housing. Thus, if the capacitor 32 is placed in series with the ballast common or neutral line, as shown in FIG. 4, then the dielectric stress between the capacitor electrodes and ground is minimized.

Figure 5:
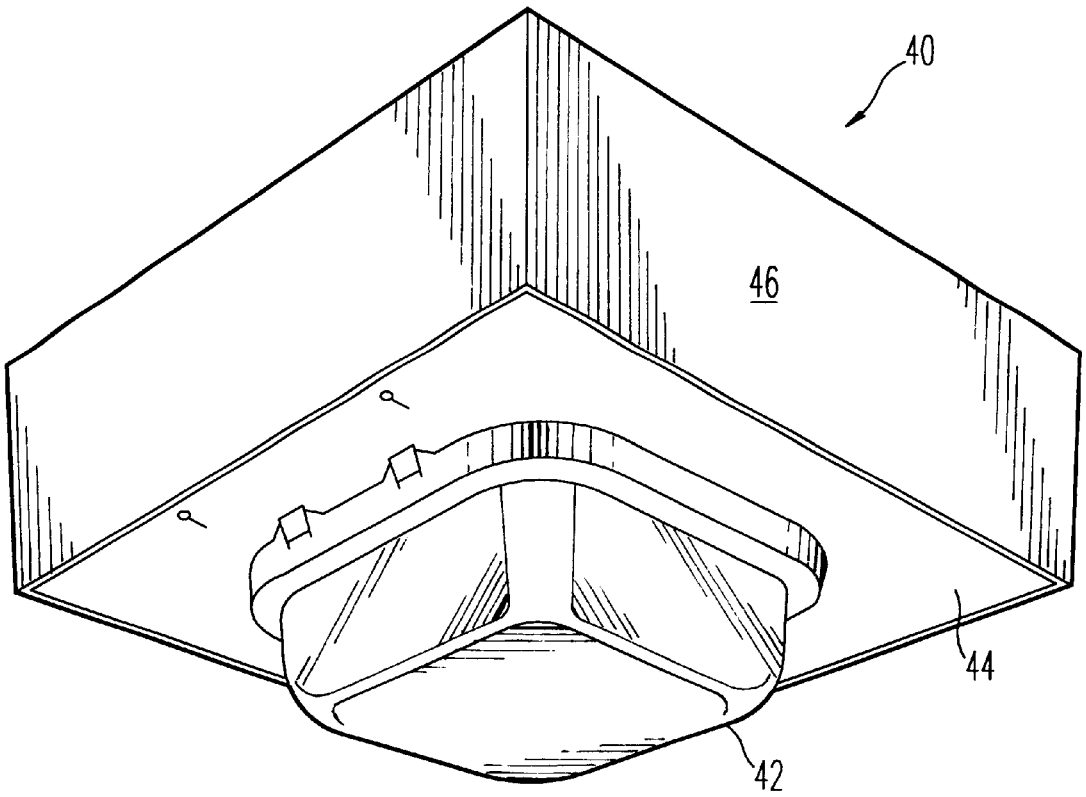
FIG. 5 illustrates an exemplary luminaire with which a lamp power level converter can be used in accordance with an embodiment of the present invention.

The ability to use an existing ballast in an existing luminaire with a different lamp having a different power ratio is advantageous for a number of reasons. For example, a different lamp can be substituted for an original lamp in a luminaire because it is more energy efficient, increases lamp life, provides improved lamp color or lumin maintenance, among other performance factors. In addition, the present invention realizes other advantages in terms of retrofit installations which will be illustrated using an under-canopy luminaire, as depicted in FIG. 5. The under-canopy luminaire 40 comprises an optical assembly 42 mounted on door 44, which is removably mounted to a housing 46. The housing contains a number of lamp circuit components (not shown) such as a ballast and a power source. Replacing a lamp in the optical assembly with a more efficient lamp was previously accomplished by mounting new ballast components to a new door having a new optical assembly for a substitute lamp. The new door replaced the existing door 44 and the lamp components in the housing 46 such as the ballast were disconnected. The ballast modification process of the present invention is advantageous when retrofitting a luminaire for a different power-rated lamp because the expense and weight of the new door and the components mounted thereon is eliminated. A new core and coil is not required since the existing ballast in the housing 46 can be used. In addition, the use of the existing core and coil takes advantage of the preferred thermal location for the magnetic devices in the housing 46. By placing a new core and coil on a new door assembly, some difficulty in transferring heat away from these new magnetic devices is presented. Also, the significant weight of the new door is avoided, as well as the additional cost for components such as a new core and coil, which are rendered unnecessary by the retrofitting process of the present invention.

Although the present invention has been described with reference to a preferred embodiment thereof, it will be understood that the invention is not limited to the details thereof. Various modifications and substitutions have been suggested in the foregoing description, and others will occur to those of ordinary skill in the art. All such substitutions are intended to be embraced within the scope of the invention as defined in the appended claims.

What is claimed is:

1. A method of retrofitting a gas discharge lamp ballast designed for use with a first lamp having a first power rating to be used with a second lamp having a second power rating, the ballast having a core, a coil and a serially-connected ballast capacitance device and being characterized by a first net impedance of the ballast reactance which allows operation of said first lamp in accordance with the operating parameters with which said first lamp was designed to operate, said ballast being connected to a power source to supply a waveform to operate said first lamp, the method comprising the step of:

replacing said first lamp with said second lamp, said second lamp having a different lamp impedance than said first lamp and different operating parameters with respect to said first lamp; and changing the capacitance of said ballast capacitance device so as to change said first net impedance of said ballast to a second net impedance of said ballast reactance, said second net impedance allowing said ballast to maintain operation of said second lamp in accordance with said different operating parameters for which said second lamp was designed to operate.

2. A method as claimed in claim 1, wherein said replacing step comprises the step of selecting a lamp for use as said second lamp which has similar operating parameters with respect to said operating parameters of said first lamp, said operating parameters being selected from the group consisting of lamp voltage, lamp current and lamp power, said changing step comprising the step of changing the capacitance of said ballast capacitance device for use with said second lamp a relatively small amount with respect to the capacitance thereof when used with said first lamp.

3. A method as claimed in claim 1, wherein said first lamp is selected from one of family of lamps comprising high pressure sodium lamps, metal halide lamps and high pressure mercury vapor lamps, said replacing step comprising the step of selecting a lamp for use as said second lamp from same said family as said first lamp.

4. A method as claimed in claim 1, wherein said first lamp is selected from one of family of lamps comprising high pressure sodium lamps, metal halide lamps and high pressure mercury vapor lamps, said replacing step comprising the step of selecting a lamp for use as said second lamp from a different said family than said first lamp.

5. A method as claimed in claim 1, said replacing step comprising the step of selecting a lamp for use as said second lamp such that said second power rating is less than said first power rating.

6. A method as claimed in claim 1, said replacing step comprising the steps of:

selecting a lamp for use as said second lamp such that said second power rating is greater than said first power rating; and protecting said ballast from overheating.

7. A method as claimed in claim 1, wherein said second lamp requires an ignition device for starting operation, and further comprising the step of connecting a first terminal and a second terminal of an ignitor circuit across the corresponding first terminal and said terminal of said second lamp.

8. A method as claimed in claim 7, wherein said ballast capacitance device is connected between a first output terminal of said ballast and said first terminal of said second lamp, said second terminal of said second lamp being connected to one of a neutral line and a grounded line to said power source, said changing step comprising the step of moving said ballast capacitance device from between said first output terminal of said ballast and said first terminal of said second lamp to between said second terminal of said second lamp and a second output terminal of said ballast.

9. A lighting device powered by an alternating current power source comprising:

a first lamp;

a ballast connected to said first lamp and said power source, said ballast being designed to operate in conjunction with a second lamp having different operating characteristics with respect to said first lamp, said first lamp being substituted for said second lamp in said lighting device, said ballast being provided with a coil, a core and a serially-connected ballast capacitor and being characterized by a first net impedance of ballast reactance which allows operation of said second lamp in accordance with operating parameters with which said second lamp was designed to operate, said first lamp being designed to operate in accordance with different operating parameters; and a retrofit capacitance device connected to said ballast in place of said ballast capacitor, said retrofit capacitance device being selected to change the reactance provided by said ballast capacitance device so as to change said first net impedance of said ballast to a second net impedance which allows said ballast to maintain operating of said first lamp in accordance with said different operating parameters.

10. A lighting device as claimed in claim 9, wherein said first lamp has similar operating parameters with respect to said operating parameters of said second lamp, said operating parameters being selected from the group consisting of lamp voltage, lamp current and lamp power, said changing step comprising the step of changing the capacitance of said ballast capacitance device for use with said first lamp a relatively small amount with respect to the capacitance thereof when used with said second lamp.

11. A lighting device as claimed in claim 9, wherein said second lamp is selected from one of family of lamps comprising high pressure sodium lamps, metal halide lamps and high pressure mercury vapor lamps, and said first lamp is from same said family as said second lamp.

12. A lighting device as claimed in claim 9, wherein said second lamp is selected from one of family of lamps comprising high pressure sodium lamps, metal halide lamps and high pressure mercury vapor lamps, and said first lamp is from a different said family than said second lamp.

13. A lighting device as claimed in claim 9, wherein said first lamp is characterized by a power rating that is less than that of said second lamp.

14. A lighting device as claimed in claim 9, wherein said first lamp is characterized by a power rating that is greater than that of said second lamp.

15. A lighting device as claimed in claim 9, wherein said second lamp requires an ignition device for starting operation, and further comprising an ignitor circuit having a first terminal and a second terminal connected to respective ones of a first terminal and said second terminal of said first lamp.

16. A lighting device as claimed in claim 15, wherein said ballast capacitor device was connected between a first output terminal of said ballast and said first terminal of said first lamp, said second terminal of said first lamp being connected to one of a neutral line and a grounded line to said power source, said ballast capacitor being moved from between said first output terminal of said ballast and said first terminal of said first lamp to between said second terminal of said first lamp and a second output terminal of said ballast.

* * * * *